United States Patent [19]

Shaw et al.

[11] Patent Number: 4,878,546

[45] Date of Patent: Nov. 7, 1989

[54] SELF-ALIGNING TOP DRIVE

[75] Inventors: Daniel G. Shaw, Conroe; Billy MacCline, Porter, both of Tex.

[73] Assignee: Triten Corporation, Houston, Tex.

[21] Appl. No.: 155,300

[22] Filed: Feb. 12, 1988

[51] Int. Cl.[4] ..... E21B 3/00

[52] U.S. Cl. ..... 173/163; 173/147; 175/85

[58] Field of Search ..... 173/57, 147, 163, 164; 175/85

[56] References Cited

U.S. PATENT DOCUMENTS

| | | | |
|---|---|---|---|
| 3,191,450 | 6/1965 | Wilson . | |
| 3,312,294 | 4/1967 | Wilson | 173/ |
| 3,380,324 | 4/1968 | Hillman | 81/ |
| 3,464,507 | 9/1969 | Alexander et al. | 175/ |
| 3,766,991 | 10/1973 | Brown | 173/ |
| 3,994,350 | 11/1976 | Smith et al. | 175/ |
| 4,037,672 | 7/1977 | Hodge | 173/ |
| 4,296,820 | 10/1981 | Loftis | 175/ |
| 4,314,611 | 2/1982 | Willis | 173/57 |
| 4,449,596 | 5/1984 | Boyadjieff | 175/ |
| 4,458,768 | 7/1984 | Boyadjieff | 175/ |
| 4,489,794 | 12/1985 | Boyadjieff | 175/ |
| 4,529,045 | 7/1985 | Boyadjieff et al. | 173/ |
| 4,605,077 | 8/1986 | Boyadjieff | 175/ |
| 4,625,796 | 12/1986 | Boyadjieff | 166/ |

*Primary Examiner*—Frank T. Yost
*Assistant Examiner*—Willmon Fridie, Jr.
*Attorney, Agent, or Firm*—Guy McClung

[57] ABSTRACT

A self-aligning top drive device and gimballing apparatus therefor. The gimballing apparatus provides horizontal and tilting movement to maintain alignment between a top drive and a tubular or tubulars suspended in a derrick, the gimballing provided by pivot pins extending from the sides of the top drive into a portion of a gimbal frame and by a pivot pin extending from the gimbal frame into a gimbal frame support. The gimbal frame support can be movably mounted on a top drive dolly to provide displacement of the top drive with respect to the dolly.

6 Claims, 6 Drawing Sheets

SELF-ALIGNING TOP DRIVE

BACKGROUND OF THE INVENTION

1. Field of the Invention.

This invention is directed to top drives for well operations including well drilling and particularly self-aligning top drives.

2. Description of Prior Art.

In many instances the drilling of a well must be conducted in a body of water. A drilling rig known as a "jack-up" is often used. A jack-up drilling rig utilizes three or four legs which are powered down to the bottom of the body of water. Upon reaching bottom the legs are further extended, thereby elevating the derrick and the supporting structure out of contact with the water which transfers all of the weight to the support legs.

Upon initial drill site installation the drilling floor is jacked essentially level through individual leg jacking. However after a passage of time, because of inconsistency of the bottom surface, the drilling structure may often assume a non-level position due to the settling of one or more legs.

Since the drill string is suspended from the top of the derrick, the axis of the pipe will tend to remain at a true vertical with respect to the bottom surface, but the axis of the derrick will be displaced from the vertical an amount in proportion to the uneveness of the drill floor.

It is common practice to mount two elongated guide rail members rigidly to the derrick means and on the true center line of the well axis. Mounted within the elongated members (guide rails) is usually found a top drilling drive and guide dolly.

Since the top drive dolly will tend to follow the guide rail whenever the drilling rig departs from a level posture, a considerable side load is created on the dolly and also the top drive central threaded shaft when hoisting a drill string of a considerable weight. This happens because the drill string will tend to remain vertical. Since the top drive must support this loading, considerable unnatural reaction forces must be absorbed and abnormal stresses are placed upon the top drive shaft, the guide rails and the guide dolly.

Prior art top drives do not effectively address this problem and have experienced many failures in the field, such as guide rail failure, dolly guide roller failure, and most serious, and often catastrophic, failure of the drill string connection brought about by side loading which causes metal fatigue of the tool joint threaded connections.

In accordance with § 156 of 37 C.F.R. the following are disclosed:

U. S. Patents

| U.S. Pat. No. | |
|---|---|
| 4,458,768 | Top Drive |
| 3,766,991 | Top Drive |
| 3,191,450 | Tiltable Rotating Device |
| 3,380,324 | Power Wrench Control |
| 3,994,350 | Rotary Drilling Rig |
| 4,449,596 | Top Drive Drilling |
| 4,314,611 | Top Drive |
| 4,296,820 | Drilling Apparatus |
| 4,037,672 | Shaft Drill System |
| 4,489,794 | Link Tilt Device |
| 3,464,507 | Portable Pipe Handler |
| 4,529,045 | Top Drive |

-continued

| U.S. Pat. No. | |
|---|---|
| 4,625,796 | Pipe Stabber and Backup Device |
| 4,605,077 | Top Drive |
| 3,312,294 | Pipe Pick-up Device |

Prior art top drives are discussed in our copending U.S. patent application entitled "Hydraulic Top Drive For Wells", Ser. No. 07/016,980 filed Feb. 26, and in the prior art cited therein. Prior art elevator link tilt mechanisms are discussed in our copending U.S. patent application Ser. No. 099,771 filed Sept. 22, 1987. Prior art rotatable fluid conductors for well apparatuses are discussed in our copending U.S. patent application filed Feb. 8, 1988.

There has long been a need for an effective and efficient self-aligning top drive. There has long been a need for an apparatus for inhibiting the stresses on top drives, dollies, and shafts caused by mis-aligned top drives. These long-felt needs are recognized, addressed, and satisfied by the present invention.

SUMMARY OF THE INVENTION

The present invention discloses a top drive mounting installation which provides a flexible mounting for the top drive. The present invention allows movement of the top drive axis laterally in two planes: fore and aft and side to side. It also allows the top drive to pivot about its axis in two planes. The ability to shift laterally and pivot axially will insure that the axis of the top drive corresponds to the true axis of the drill pipe even though these axes depart from the derrick and guide rail axes. The flexible mounting is accomplished by a dual gimbal mounting on the sides of the top drive and a gimbal mounting on the rear. Pivot pins on the side of the top drive extending into holes in a gimbal frame provide sliding horizontal motion with respect to the frame and rotary motion of the pins in the holes. A rear pivot pin mounted to the gimbal frame movably extends through a hole in a gimbal support to provide horizontal displacement and rotary motion. The gimbal support can be movably secured to a top drive dolly.

It is therefore an object of the present invention to provide a novel, unobvious, and efficient self-aligning top drive for wells.

Another object of this invention is the provision of a gimballing apparatus for a top drive which permits lateral and tilting motion.

Yet another object of this invention is the provision of a movable support for such a gimballing apparatus.

A further object of this invention is the provision of such a support which can be movably secured to a top drive dolly.

To one who has the benefits of the teachings of this invention, other and further objects and advantages as well as those inherent in the invention will be clear to a person of skill in the art when reviewing the following description of preferred embodiments when taken in conjunction with the accompanying drawings.

DESCRIPTION OF PREFERRED EMBODIMENTS

Although these descriptions are detailed to insure adequacy and aid understanding, this is not intended to prejudice that purpose of a patent which is to claim an invention no matter how others may later disguise it by variations in form or additions or further improvements. The claims at the end hereof are intended as the chief aid toward this purpose.

Figure 1:
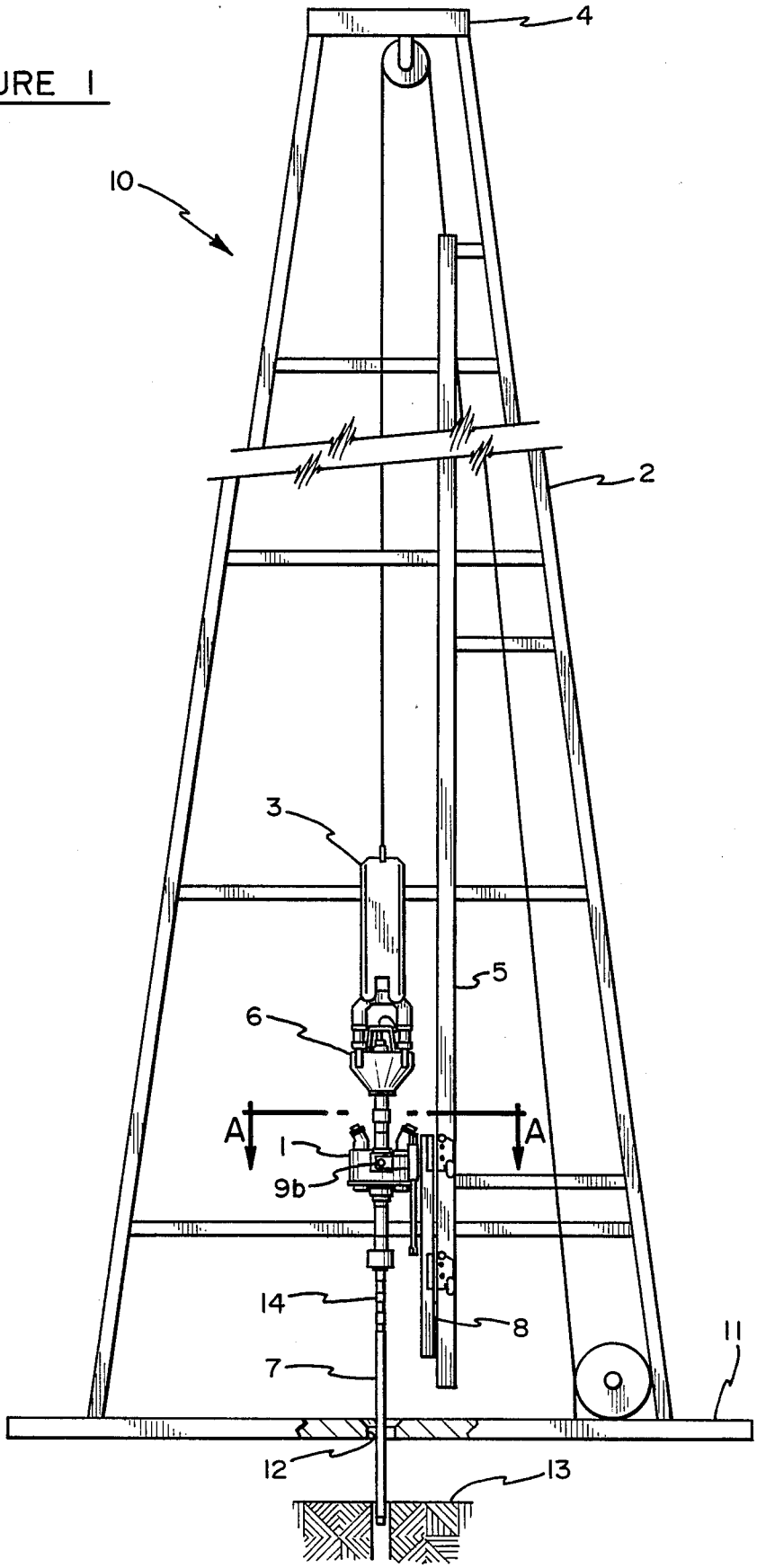
FIG. 1 is a schematic side view of a top drive drilling system employing the present invention.

Referring to FIG. 1 in a well drilling rig 10, the top drive 1 is threadably connected to a conventional oil well swivel 6 and a traveling block 3 and is suspended from a crown block 4 which is supported by a derrick 2. The top drive 1 is connected to and supports a wheeled dolly 8 through the use of pivot pins 9. The dolly 8 is guided upwardly and downwardly by elongated members 5 which are attached to the derrick 2. Threadably connected to a top drive shaft 14 is a drill string 7 which extends through an opening 12 in a drill rig floor 11 into the earth 13 in order to drill a well. FIG. 1 is a diagrammic representation of a properly aligned drilling system in which the derrick 2 is essentially in a correct and upright position.

Figure 2:
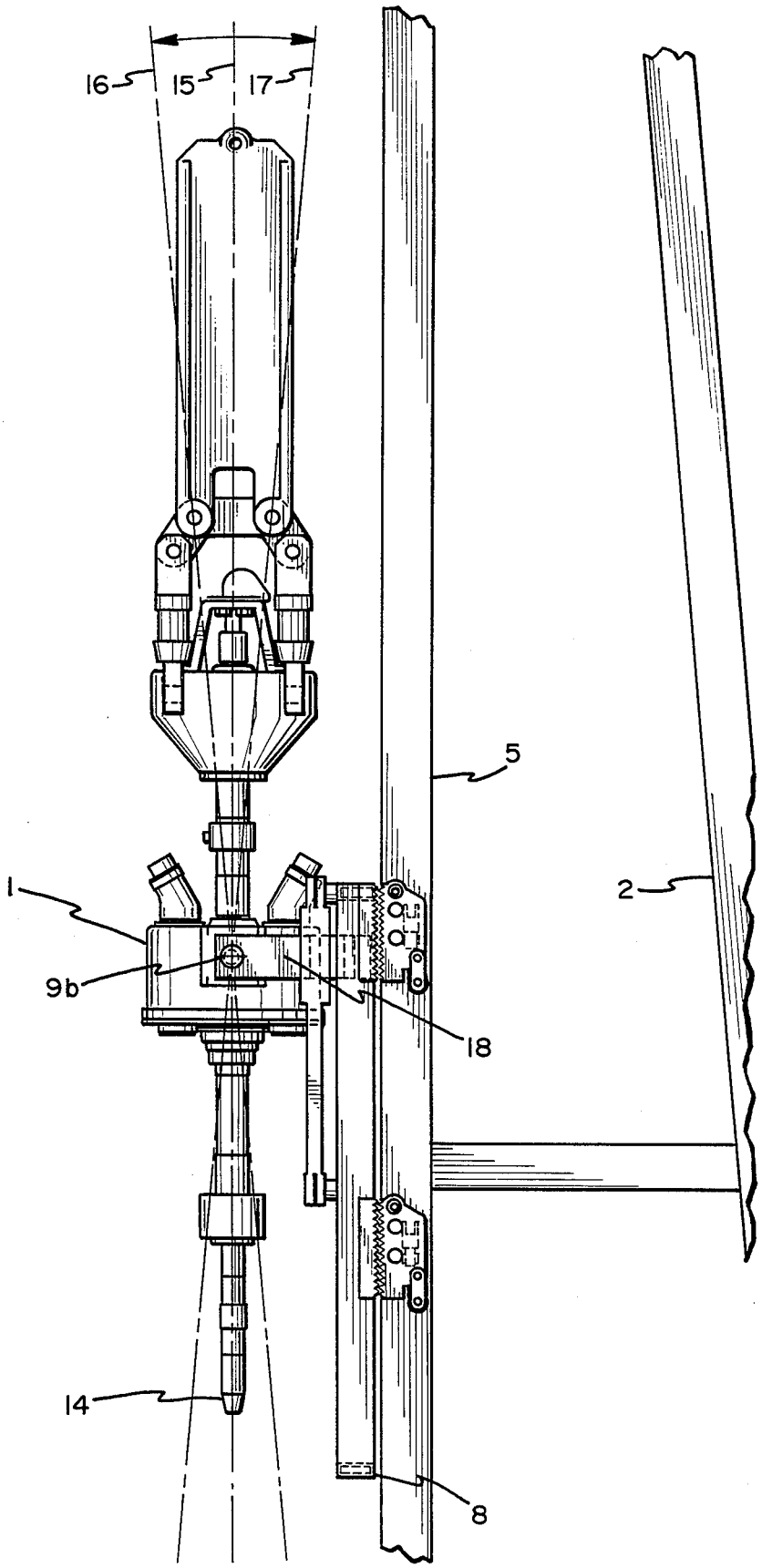
FIG. 2 is an enlarged side view of a portion of the system of FIG. 1.

As illustrated in FIG. 2, the top drive 1 in one instance has its axis aligned along a line 15, a true vertical axis. Lines 16 and 17 depict planes to which the axis can be aligned. A gimbal frame 18 supports the top drive 1 on the pivot pins **9*a* and 9*b* which movably extend through holes 45*a* and 45*b*, respectively, in arms 47 and 48, respectively, of the frame 18**.

Figure 3:
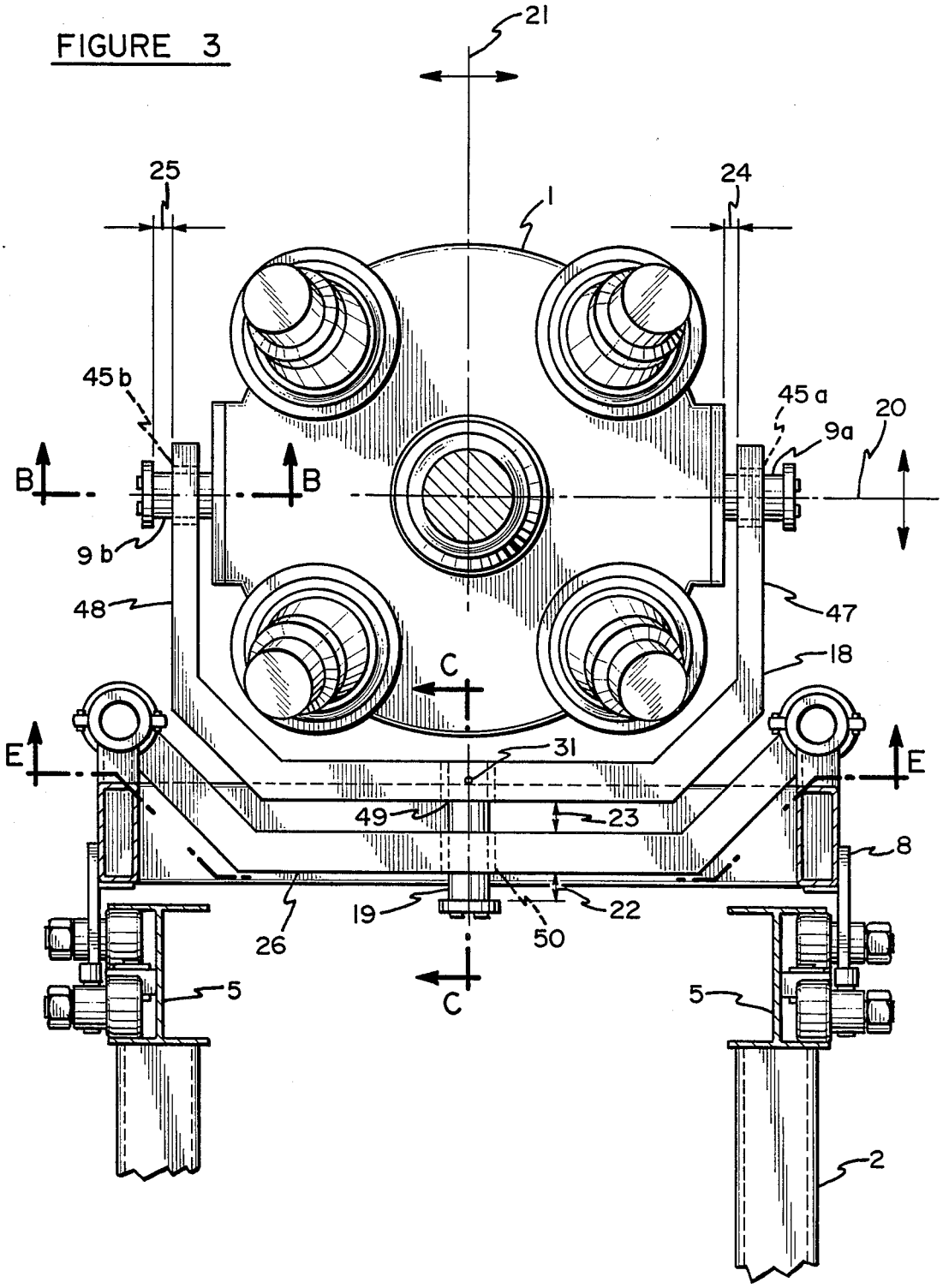
FIG. 3 is a top view partially in cross section along line A—A of FIG. 1.

Referring now to FIG. 3, the pivot pins **9*a* and 9*b* projecting through the gimbal frame 18 are so fitted that they are allowed to slide distances 24 or 25, respectively, thereby allowing a center line 21 of top drive 1 to be displaced that distance in either direction. A rear gimbal pin 19 secured to the rear of the frame 18 through a hole 49 is slidably disposed within a gimbal frame support 26 which allows a center line 20 to move distances 22 or 23**.

Figure 4:
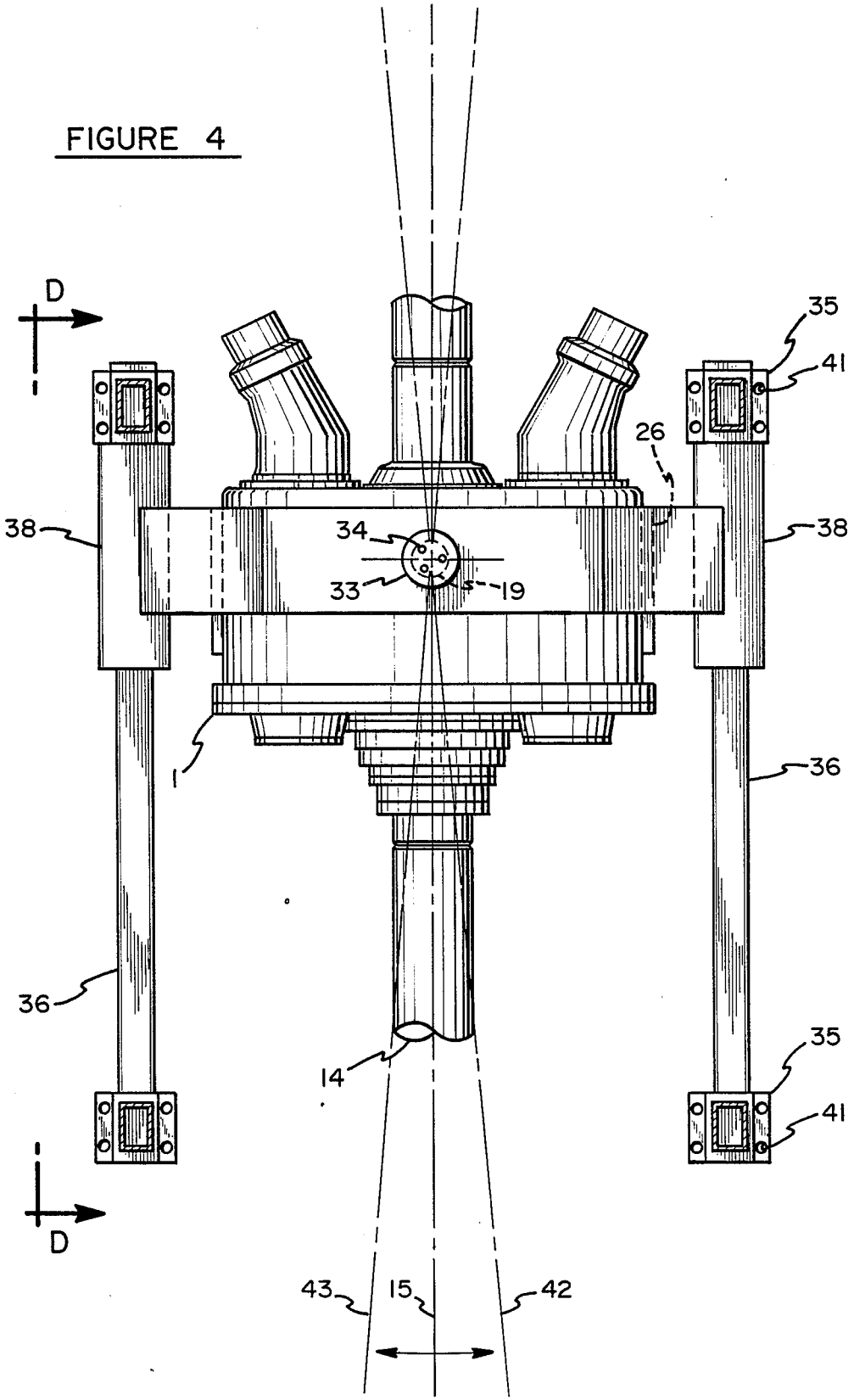
FIG. 4 is a view, along line E—E of FIG. 3.

As shown in FIG. 4, the gimbal frame support 26 is slidably connected to cylindrical shafts 36 disposed about tubular elements 38 of gimbal support 26. The rear pin 19 is rotatably disposed within a hole 50 in the gimbal frame support 26. The top drive 1 is pictured with its vertical axis truly vertical. Axes 42 and 43 depict the possible displacement of the top drive center line.

Figure 5:
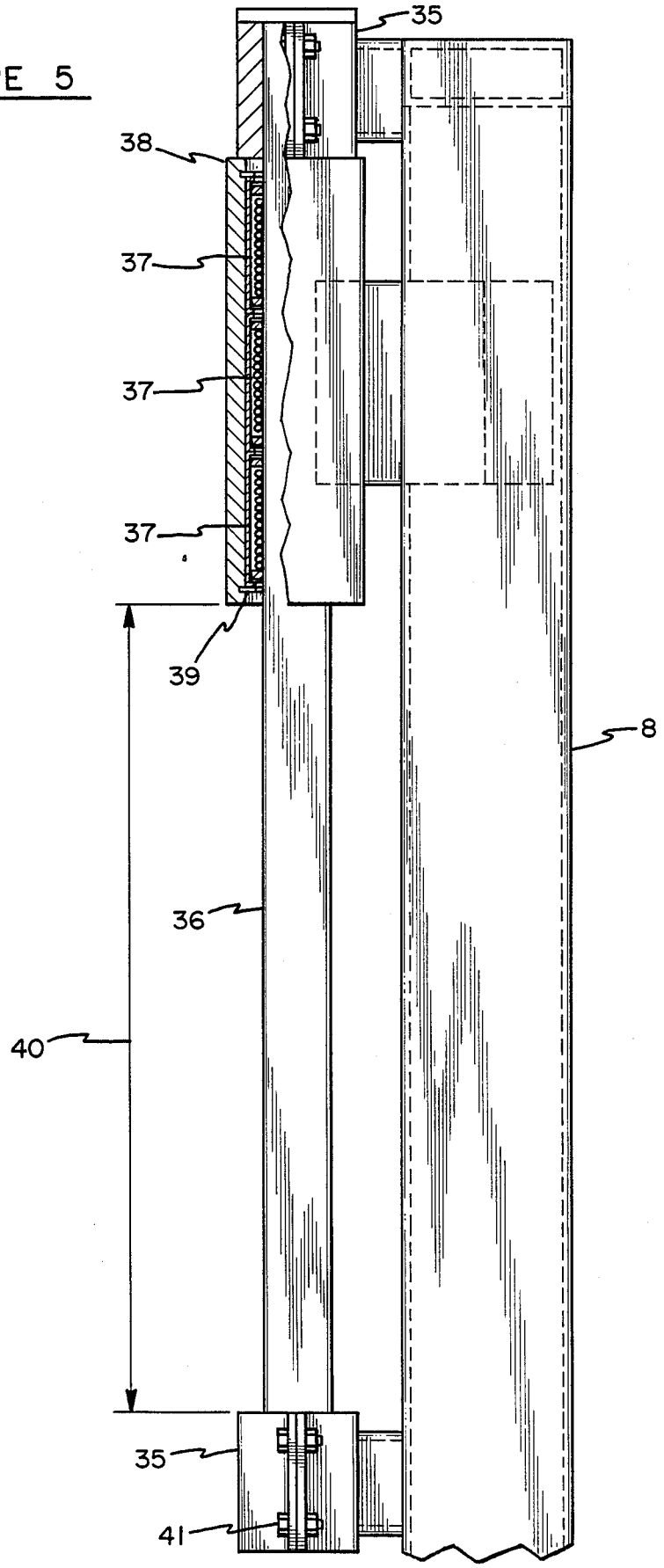
FIG. 5 is a partial side view along line D—D of FIG. 4.

In FIG. 5 is shown a cylindrical shaft 36 attached to a dolly 8 with a split clamp 35. Disposed about a shaft 36 are ball roller bushings 37 (commercially available items). Disposed about the ball bushings 37 is a tubular element 38 which is a part of the gimbal support 26. The rolling element ball bushings 37 allow the gimbal frame support 26 to move a distance 40. Threaded fasteners 41 connect the split clamp halves 35 to the dolly frame 8.

Figure 6:
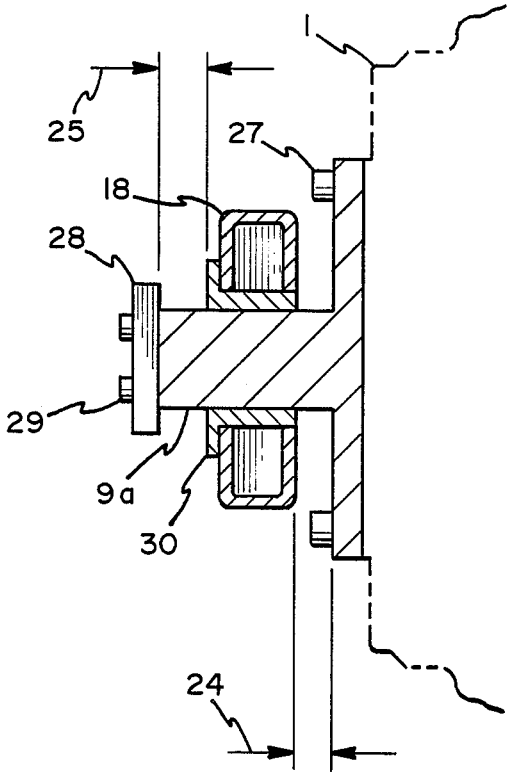
FIG. 6 is a cross sectional view of pivot pins and gimbal along line B—B of FIG. 3.

Referring to FIG. 6, disposed about each of the pivot pins **9*a* and 9*b* is a sliding fitted bearing 30 projecting within the gimbal frame 18. (only 9*a* is shown; 9*b*'s disposition is the same) A retaining plate 28 is attached to the pivot pin 9*a* by threaded fasteners 29. The pivot pin 9*a* is attached to top drive 1 with a threaded fastener 27. The relative diameters of the pivot pin 9*a* and the bearing 30 allow both sliding and rotating motion between the pivot pin 9*a* and bearing 30. Travel in both directions to the extent of distances 24, 25** is permitted.

Figure 7:
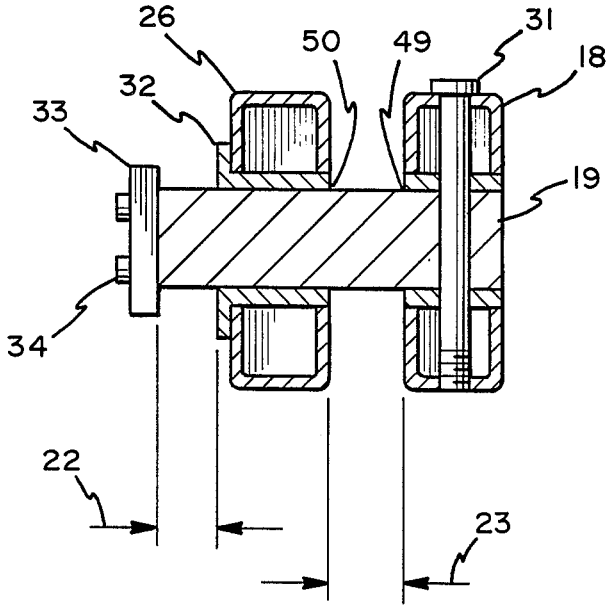
FIG. 7 is a cross sectional view of the rear pivot pin along line C—C of FIG. 3.

As shown in FIG. 7, disposed about the gimbal pin 19 is a bearing 32. The pin 19 is attached to the gimbal frame 18 with a drive pin 31. A retaining plate 33 is attached to the pin 19 with a threaded fastener 34. The relative fit between the outside diameter of the gimbal pin 19 and the inside diameter of the bearing 32 is such that both rotary motion and displacement to the extent of distances 22 and 23 is possible.

In conclusion, therefore, it is seen that the present invention and the embodiments disclosed herein are well adapted to carry out the objectives and obtain the ends set forth at the outset as well as others inherent therein. Certain changes can be made in the methods and apparatuses disclosed without departing from the spirit and the scope of this invention. While there have been described various embodiments of the present invention, the methods and apparatuses described are not intended to be understood as limiting the scope of the invention. It is realized that changes therein are possible and it is further intended that each element recited in any of the following claims, and each combination of elements, is to be understood as referring to all equivalent elements, and equivalent combinations, for accomplishing substantially the same results in substantially the same or equivalent manner. It is intended that the claims cover the invention broadly in whatever form its principles may be utilized.

What is claimed is:

1. A self-aligning top drive apparatus for well operations with tubulars suspended from a derrick, the top drive apparatus mountable to the derrick, the derrick having a central derrick vertical axis, the top drive apparatus comprising top drive means, gimbal mean to which the top drive means is movably mounted, the movable mounting of the top drive means to the gimbal means providing for movement of the top drive means at right angles to the central derrick vertical axis and also for tilting movement with respect to said axis to maintain the top drive means in alignment with the tubulars, a first pivot pin extends from a first side of the top drive means and a second pivot pin extends from a second side of the top drive means opposite to the first side, and the gimbal means comprising a gimbal frame disposed about the top drive means, the gimbal frame having two holes therein one each for receiving one of the two pivot pins, each of the pivot pins slidable and rotatable in its respective hole, a gimbal pin secured to the gimbal frame, a gimbal frame support disposed about the gimbal frame, the gimbal frame support having an opening therethrough for receiving the gimbal pin, the gimbal pin slidably and movably extending through the opening in the gimbal frame support, dolly means movably mounted for upward and downward movement in the derrick, and gimbal mount means for securing the gimbal means to the dolly means.

2. A gimballing apparatus for a top drive mounted to a derrick for well operations with tubulars suspended from the derrick, the derrick having a central vertical axis, the first pivot pin extending from a first side of the top drive and a second pivot pin extending from a second side of the top drive opposite to the first side, the gimballing apparatus comprising a gimbal disposed about the top drive, the gimbal frame having two holes therein one each for receiving one of the two pivot pins, each of the pivot pins slidable anD rotatable in its respective hole, a gimbal pin secured to the gimbal frame, a gimbal frame support disposed about the gimbal frame, the gimbal frame support having an opening therethrough for receiving the gimbal pin, the gimbal slidably and movably extending through the opening in the gimbal frame support.

dolly means movably mounted for upward and downward movement in the derrick, and gimbal mount means for securing the gimballing apparatus to the dolly means.

3. The apparatus of claim 2 wherein the gimbal mount means is movable on the dolly means to provide displacement of the top drive with respect to the dolly means.

4. A self-aligning top drive apparatus for well operations with tubulars suspended from a derrick, the self-aligning top drive apparatus mountable to the derrick, the derrick having a central derrick vertical axis, the top drive apparatus having a first pivot pin extending from a first side of the top drive means and a second pivot pin extending from a second side of the top drive means opposite to the first side, and the self-aligning top drive apparatus comprising top drive means, gimbal means to which the top drive means is movably mounted, the gimbal means comprising a gimbal frame disposed about the top drive means, the gimbal frame having two holes therein one each for receiving one of the two pivot pins, each of the pivot pins slidable and rotatable in its respective hole, a gimbal pin secured to the gimbal frame, a gimbal frame support disposed about the gimbal frame, the gimbal frame support having an opening therethrough for receiving the gimbal pin, the gimbal pin slidably and movably extending through the opening in the gimbal frame support, and the movable mounting of the top drive means to the gimbal means providing for pivoting and lateral movement of the top drive means with respect to the central derrick axis and for tilting movement with respect to said axis to maintain the top drive means in alignment with the tubulars.

5. A self-aligning top drive apparatus for well operations with tubulars suspended from a derrick, the self-aligning top drive apparatus mountable to the derrick, the derrick having a central derrick vertical axis, the self-aligning top drive apparatus comprising top drive means, gimbal means to which the top drive means is movably mounted, the movable mounting of the top drive means to the gimbal means providing for pivoting and lateral movement of the top drive means with respect to the central derrick axis and for tilting movement with respect to said axis to maintain the top drive means in alignment with the tubulars, dolly means movably mounted for upward and downward movement in the derrick, and gimbal mount means for securing the gimbal gimbal means to the dolly means.

6. The apparatus of claim 5 wherein the gimbal mount means is movable on the dolly means to provide displacement of the top drive means with respect to the dolly means.

* * * * *